US011519673B2

(12) United States Patent
Yoshimura et al.

(10) Patent No.: US 11,519,673 B2
(45) Date of Patent: Dec. 6, 2022

(54) PLATE HEAT EXCHANGER AND HEAT PUMP DEVICE INCLUDING THE SAME

(71) Applicant: Mitsubishi Electric Corporation, Tokyo (JP)

(72) Inventors: Susumu Yoshimura, Tokyo (JP); Faming Sun, Tokyo (JP); Yoshitaka Eijima, Tokyo (JP); Sho Shiraishi, Tokyo (JP); Masahiro Yokoi, Tokyo (JP); Ryosuke Abe, Tokyo (JP); Kazutaka Suzuki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/971,697

(22) PCT Filed: Feb. 28, 2019

(86) PCT No.: PCT/JP2019/007859
§ 371 (c)(1),
(2) Date: Aug. 21, 2020

(87) PCT Pub. No.: WO2019/176567
PCT Pub. Date: Sep. 19, 2019

(65) Prior Publication Data

US 2020/0408465 A1 Dec. 31, 2020

(30) Foreign Application Priority Data

Mar. 15, 2018 (JP) ..... JP2018-047956

(51) Int. Cl.
*F28D 9/00* (2006.01)
*F28F 3/06* (2006.01)
*F28F 3/08* (2006.01)

(52) U.S. Cl.
CPC ..... *F28D 9/005* (2013.01); *F28D 9/0056* (2013.01); *F28F 3/06* (2013.01); *F28F 3/086* (2013.01); *F28F 2275/04* (2013.01)

(58) Field of Classification Search
CPC ..... F28D 9/0037; F28D 9/005; F28D 9/0043; F28D 9/0062; F28F 1/124; F28F 2215/04;
(Continued)

(56) References Cited

U.S. PATENT DOCUMENTS 4,645,000 A * 2/1987 Scarselletta ..... F28D 1/05366 165/152
4,872,578 A * 10/1989 Fuerschbach ..... F28D 9/005 165/167

(Continued)

FOREIGN PATENT DOCUMENTS

CN 202195728 U 4/2012
CN 102472540 A 5/2012

(Continued)

OTHER PUBLICATIONS

International Search Report and Written Opinion dated May 21, 2019 for PCT/JP2019/007859 filed on Feb. 28, 2019, 8 pages including English Translation of the International Search Report.

(Continued)

*Primary Examiner* — Jianying C Atkisson
*Assistant Examiner* — For K Ling
(74) *Attorney, Agent, or Firm* — Xsensus LLP

(57) ABSTRACT

A plate heat exchanger includes heat transfer plates each of which has openings at four corners thereof, and which are stacked together. The heat transfer plates are partially brazed together such that a first flow passage through which first fluid flows and a second flow passage through which second fluid flows are alternately arranged, with an associated heat transfer plate interposed between the first and second flow (Continued)

passages. The openings at each of the four corners communicate with each other, thereby forming a first header and a second header, the first header allowing the first fluid to flow into and flow out of the first flow passage, the second header allowing the second fluid to flow into and flow out of the second flow passage.

22 Claims, 12 Drawing Sheets

(58) Field of Classification Search
CPC .... F28F 3/022; F28F 3/08; F28F 3/083; F28F 3/086
See application file for complete search history.

(56) References Cited

U.S. PATENT DOCUMENTS

| | | | | |
|---|---|---|---|---|
| 6,253,566 | B1 * | 7/2001 | Ichikawa | F25B 1/047 62/228.1 |
| 6,298,910 | B1 * | 10/2001 | Komoda | F28F 19/06 165/167 |
| 2002/0185260 | A1 * | 12/2002 | Calaman | H01L 23/473 165/80.4 |
| 2003/0201094 | A1 * | 10/2003 | Evans | F28F 3/027 165/109.1 |
| 2011/0088882 | A1 | 4/2011 | Persson | |
| 2012/0111042 | A1 | 5/2012 | Hamada et al. | |
| 2015/0083379 | A1 * | 3/2015 | Ito | F28D 9/005 165/166 |
| 2016/0040943 | A1 | 2/2016 | Han et al. | |
| 2016/0356560 | A1 | 12/2016 | Wei et al. | |

FOREIGN PATENT DOCUMENTS

| | | | | | |
|---|---|---|---|---|---|
| CN | 103759474 | A | | 4/2014 | |
| CN | 205227939 | U | | 5/2016 | |
| DE | 41 00 651 | A1 | | 7/1992 | |
| DE | 10 2015 012 029 | A1 | | 3/2017 | |
| JP | 2001-099587 | A | | 4/2001 | |
| JP | 2006-183969 | A | | 7/2006 | |
| JP | 2006183969 | A | * | 7/2006 | F28D 9/005 |
| JP | 2010-002123 | A | | 1/2010 | |
| JP | 2012-127597 | A | | 7/2012 | |
| JP | 2014-066411 | A | | 4/2014 | |
| JP | 2016-099093 | A | | 5/2016 | |

OTHER PUBLICATIONS

Office Action dated May 26, 2021, in corresponding Chinese patent Application No. 201980016987.7, 18 pages.
Office Action dated Oct. 25, 2021 issued in corresponding Chinese patent application No. 201980016987.7.
Office Action dated Nov. 11, 2021 issued in corresponding German patent application No. 11 2019 001 350.5.
Office Action dated Apr. 18, 2022 in Chinese Patent Application No. 201980016987.7, 14 pages.

* cited by examiner

PLATE HEAT EXCHANGER AND HEAT PUMP DEVICE INCLUDING THE SAME

CROSS-REFERENCE TO RELATED APPLICATIONS

The present application is based on PCT filing PCT/JP2019/007859, filed Feb. 28, 2019, which claims priority to JP 2018-047956, filed Mar. 15, 2018, the entire contents of each are incorporated herein by reference.

TECHNICAL FIELD

The present disclosure relates to a plate heat exchanger including heat transfer plates having double wall structures and a heat pump device including the plate heat exchanger.

BACKGROUND ART

An existing plate heat exchanger includes a plurality of heat transfer plates each of which have openings at four corners thereof and irregular or corrugated surfaces, and which are stacked and brazed together at outer wall portions of the heat transfer plates and in regions around the openings, thereby forming first flow passages through which first fluid flows and second flow passages through which second fluid flows, such that the first flow passages and the second flow passages are alternately formed. The openings at the four corners are provided such that openings at each of the four corners communicate with each other, thereby forming a first (second) header that allows first (second) fluids flow into and out of the first (second) flow passages. In the plate heat exchanger, each heat transfer plate has a double wall structure in which a pair of metal plates are brought together (see, for example Patent Literature 1).

The plate heat exchanger according to Patent Literature 1 includes heat transfer plates each having a double wall structure. Therefore, even if, for example, corrosion or freezing occurs and cracks are formed in one of the heat transfer plates, it is possible to prevent the flow passages from communicating with each other, and refrigerant from leaking into an indoor space. Also, fluid that has leaked to the outside of the heat changer is detected by a detection sensor, and in this case, a device including the plate heat exchanger is stopped. The device is thus prevented from being damaged.

CITATION LIST

Patent Literature

Patent Literature 1: Japanese Unexamined Patent Application Publication No. 2014-66411

SUMMARY OF INVENTION

Technical Problem

In a stacking structure disclosed in Patent Literature 1, when one of a pair of metal plates that are brought together cracks, fluid that has leaked needs to be made to flow out to the outside of the heat exchanger. Therefore, the pair of metal plates are brought into tight contact with each other, but are not metal-joined together. Thus, an air layer is present between the pair of metal plates, and acts as a thermal resistance that greatly reduces the heat transfer performance. Furthermore, in the case where the pair of metal plates are strongly brought into tight contact with each other to improve the heat transfer performance, the fluid that has leaked cannot easily flow out the outside and thus cannot be easily detected in a region outside the heat exchanger.

The present disclosure is applied to solve the above problem, and relates to a plate heat exchanger in which deterioration of the heat transfer performance, which is a disadvantage of a double wall structure, can be reduced, and even if, for example, corrosion or freezing occurs and a crack is formed in a heat transfer plate, fluid that has leaked can be made to flow out to the outside of the heat exchanger without being mixed with another fluid, and be detected in a region outside the heat exchanger, and also to a heat pump device including the plate heat exchanger

Solution to Problem

A plate heat exchanger according to an embodiment of the present disclosure includes a plurality of heat transfer plates each of which has openings at four corner portions thereof, and which are stacked together. The plurality of heat transfer plates are partially brazed together such that a first flow passage through which first fluid flows and a second flow passage through which second fluid flows are alternately arranged, with an associated one of the plurality of heat transfer plates interposed between the first flow passage and the second flow passage. The openings at the four corner portions are provided such that the openings at each of the four corner portions communicate with each other, thereby forming a first header and a second header. The first header allows the first fluid to flow into and flow out of the first flow passage, and the second header allows the second fluid to flow into and flow out of the second flow passage. In each of the first flow passage and the second flow passage, inner fins are provided. At least one of two of the plurality of heat transfer plates between which the first flow passage or the second flow passage is located is formed by stacking two metal plates together. The two metal plates are partially brazed together at a brazed portion such that a plurality of outflow passages are formed between the two metal plates along overlapping surfaces thereof and communicate with the outside of the heat exchanger.

Advantageous Effects of Invention

In the plate heat exchanger according to the embodiment of the present disclosure, the pair of metal plates formed to have a double wall structure are partially brazed together at the brazed portion such that the outflow passages are formed between the pair of metal plates along the overlapping surfaces thereof, and communicate with the outside of the heat exchanger. Therefore, the deterioration of the heat transfer performance can be more greatly reduced that in the existing plate heat exchanger in which each pair of metal plates are brought into tight contact with each other, but are not metal-joined together. In addition, even if, for example, corrosion or freezing occurs and a crack is formed in the heat transfer plates, fluid that has leaked can be made to flow out to the outside of the heat exchanger without being mixed with another fluid, and can be detected in a region outside the heat exchanger.

DESCRIPTION OF EMBODIMENTS

Figure 1:
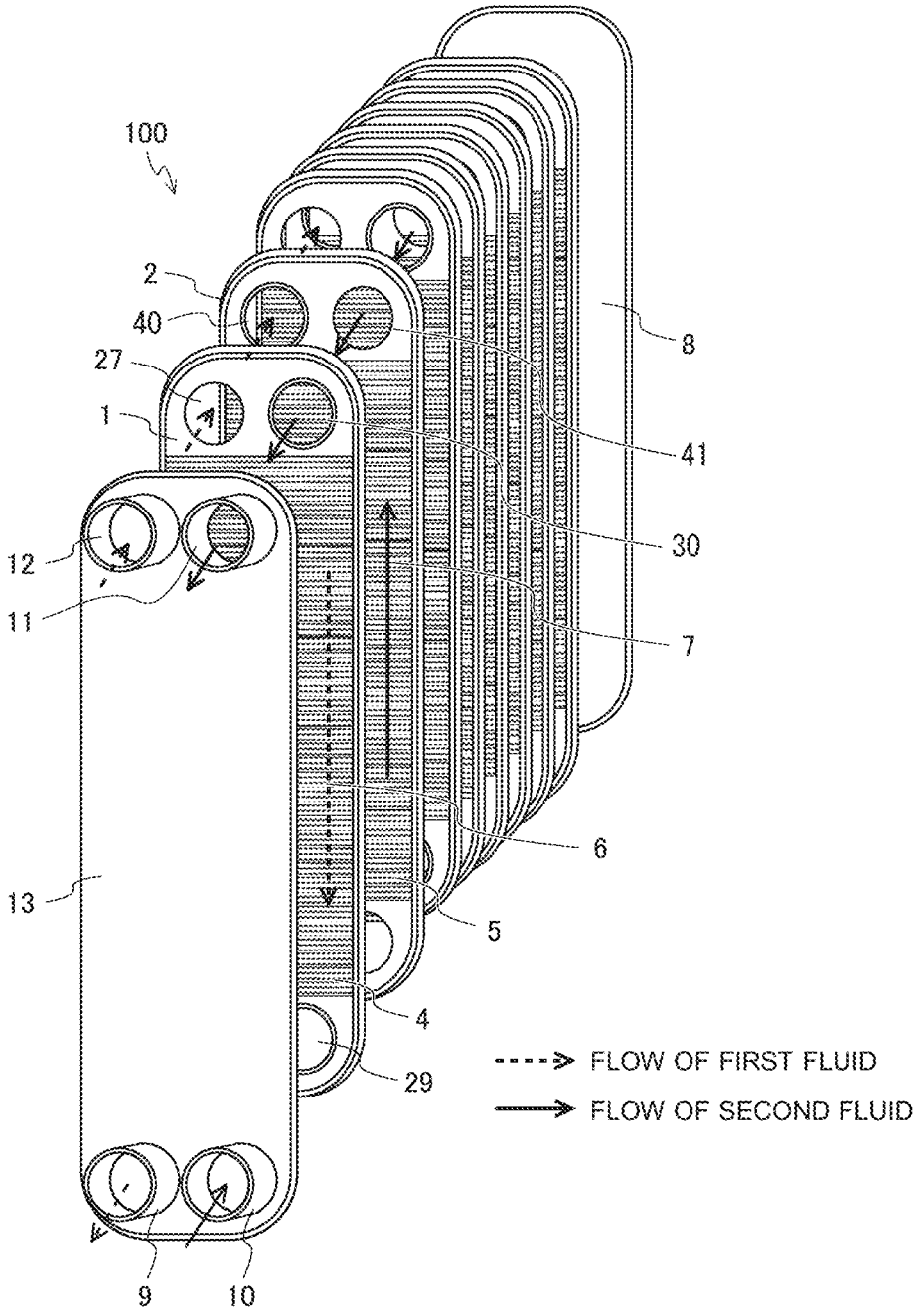
FIG. 1 is an exploded perspective view of a plate heat exchanger according to Embodiment 1 of the present disclosure.

Embodiments of the present disclosure will be described with reference to the drawings. Descriptions of the embodiments that will be made below are not limiting. In the drawings, the relationships between the sizes of components may differ from the actual relationships.

Embodiment 1

Figure 2:
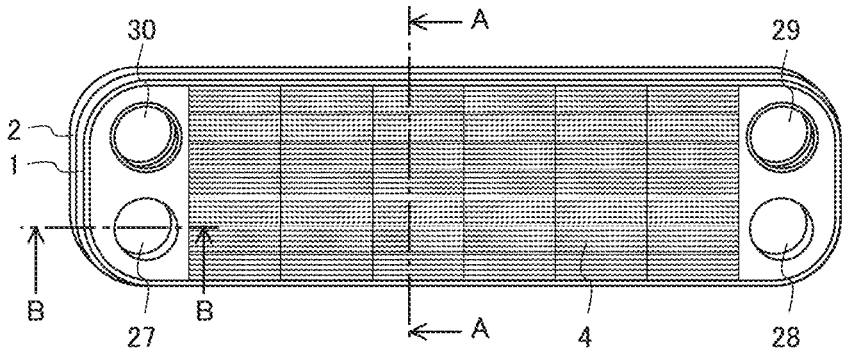
FIG. 2 is a front perspective view of heat transfer plates included in the plate heat exchanger according to Embodiment 1 of the present disclosure.
Figure 3:
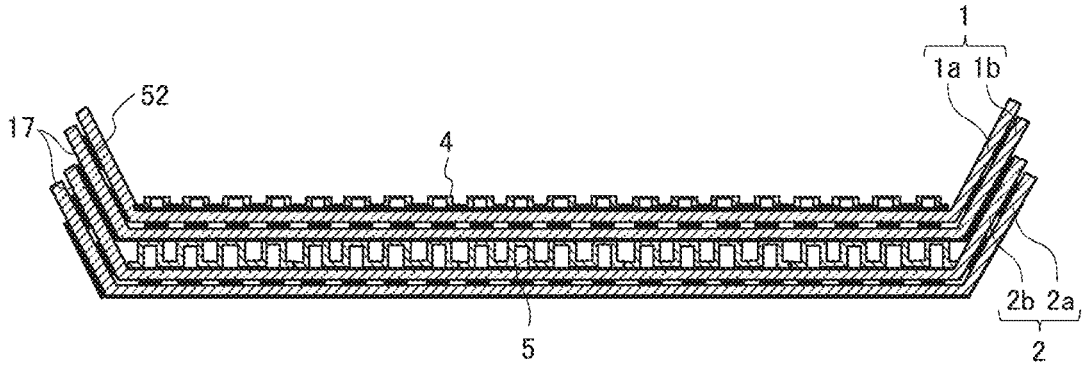
FIG. 3 is a sectional view of the heat transfer plates included in the plate heat exchanger according to Embodiment 1 of the present disclosure taken along line A-A in FIG. 2.
Figure 4:
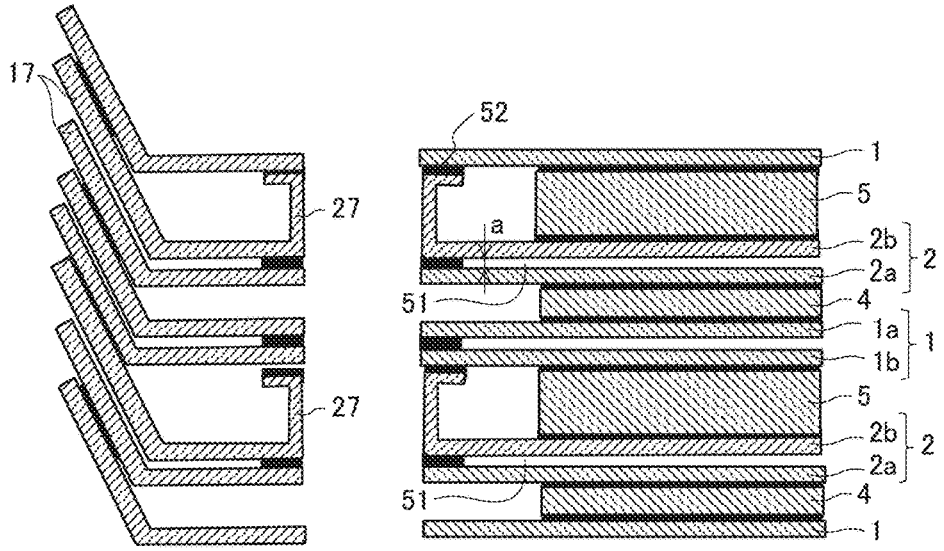
FIG. 4 is a sectional view of the heat transfer plates included in the plate heat exchanger according to Embodiment 1 of the present disclosure, which is taken along line B-B in FIG. 2.

FIG. 1 is an exploded perspective view of a plate heat exchanger 100 according to Embodiment 1 of the present disclosure. FIG. 2 is a front perspective view of heat transfer plates 1 and 2 included in the plate heat exchanger 100 according to Embodiment 1 of the present disclosure. FIG. 3 is a sectional view of the heat transfer plates 1 and 2 included in the plate heat exchanger 100 according to Embodiment 1 of the present disclosure, which is taken along line A-A in FIG. 2. FIG. 4 is a sectional view of the heat transfer plates 1 and 2 included in the plate heat exchanger 100 according to Embodiment 1 of the present disclosure, which is taken along line B-B in FIG. 2. FIG. 4 illustrates a plurality of heat transfer plates 1 and a plurality of heat transfer plates 2.

In FIG. 1, dotted line arrows indicate the flow of first fluid, and solid line arrows show the flow of second fluid. In FIGS. 3 and 4, solid blacked regions are brazed portions 52.

As illustrated in FIG. 1, the plate heat exchanger 100 according to Embodiment 1 includes a plurality of heat transfer plates 1 and 2, which are alternately stacked. As illustrated in FIG. 2, the heat transfer plates 1 and 2 have a rectangular shape with round corners and include flat overlapping surfaces. Each of the heat transfer plates 1 and 2 has openings 27 to 30 at four corners thereof. As illustrated in FIGS. 3 and 4, the heat transfer plates 1 and 2 include outer wall portions 17 at edges thereof, and the outer wall portions 17 are bent from the heat transfer plates 1 and 2 in the stacking direction. In Embodiment 1, the heat transfer plates 1 and 2 have a rectangular shape with round corners.

The heat transfer plates 1 and 2 are brazed together at the outer wall portions 17 and in regions around the openings 27 to 30. To cause heat exchange to be performed between the first fluid and the second fluid, first flow passages 6 in which the first fluid flows and second flow passages 7 in which the second fluid flows are alternately arranged, with the heat transfer plates 1 and 2 alternately interposed between the first flow passages and the second flow passages.

As illustrated in FIGS. 1 and 2, the openings 27 to 30 at the four corners are provided such that the openings 27 communicate with each other, the openings 28 communicate with each other, the openings 29 communicate with each other, and the openings 30 communicate with each other, thereby forming a first header and a second header. The first header allows the first fluid to flow into and out of the first flow passage 6, and the second header allows the second fluid to flow into and out of the second flow passage 7. To ensure sufficient fluid flow velocities and improve performance, the heat transfer plates 1 and 2 are arranged such that long sides of the heat transfer plates 1 and 2 extend in a direction in which the fluids flow; that is, the longitudinal direction of the heat transfer plates 1 and 2 is the same as the flow direction of the flows, and short sides of the heat transfer plates 1 and 2 are perpendicular to the longitudinal direction.

In the first flow passages 6 and the second flow passages 7, inner fins 4 and inner fins 5 are provided, respectively. As illustrated in FIGS. 3 and 4, the heat transfer plates 1 and 2 have double wall structures obtained by joining pairs of metal plates (1*a* and 1*b*) (2*a* and 2*b*) together. The inner fins 4 and 5 are fins provided between the pairs of metal plates (1*a* and 1*b*) (2*a* and 2*b*).

The metal plates 1*a* and 2*a* are adjacent to the first flow passages 6 in which the inner fins 4 are provided, and the metal plates 1*b* and 2*b* are adjacent to the second flow passages 7 in which the inner fins 5 are provided.

The metal plates 1*a*, 1*b*, 2*a*, and 2*b* are formed of, for example, stainless steel, carbon steel, aluminum, copper, or an alloy thereof. The following description is made with respect to the case where the metal plates 1*a*, 1*b*, 2*a*, and 2*b* are formed of stainless steel.

As illustrated in FIG. 1, a first reinforcing side plate 13 having openings at four corners thereof and a second reinforcing side plate 8 are provided on the outermost surfaces of the heat transfer plates 1 and 2 in the stacking direction. The first reinforcing side plate 13 and the second reinforcing side plate 8 have a rectangular shape with round corners and include flat overlapping surfaces. Referring to FIG. 1, the first reinforcing side plate 13 is located on the foremost side, and the second reinforcing side plate 8 is located on the rearmost side. In Embodiment 1, the first reinforcing side plate 13 and the second reinforcing side plate 8 have a rectangular shape with round corners.

In the openings in the first reinforcing side plate 13, a first inlet pipe 12, a first outlet pipe 9, a second inlet pipe 10, and a second outlet pipe 11 are provided. The first inlet pipe is a pipe into which the first fluid flows, the first outlet pipe 9 is a pipe from which the first fluid flows out, the second inlet pipe 10 is a pipe into which the second fluid flows, and the second outlet pipe 11 is a pipe from which the second fluid flows out.

The above first fluid is, for example, refrigerant such as R410A, R32, R290, or $CO_2$, and the above second fluid is, for example, water, an antifreeze such as ethylene glycol or propylene glycol, or a mixture thereof.

Figure 5:
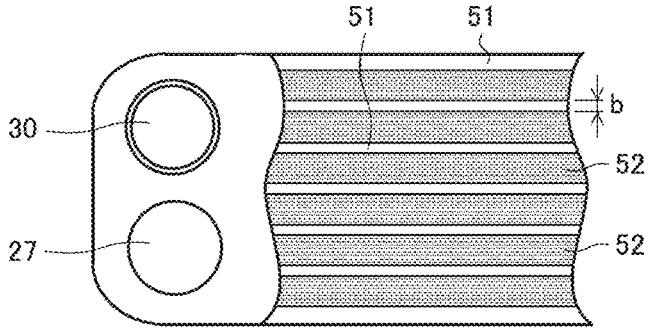
FIG. 5 is a partial schematic diagram illustrating a region between each of pairs of metal plates that form the heat transfer plates included in the plate heat exchanger according to Embodiment 1 of the present disclosure.
Figure 6:
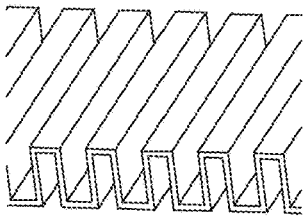
FIG. 6 is a perspective view of a first example of inner fins included in the plate heat exchanger according to Embodiment 1 of the present disclosure.
Figure 7:
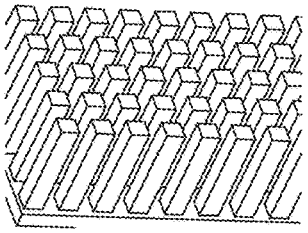
FIG. 7 is a perspective view of a second example of the inner fins included in the plate heat exchanger according to Embodiment 1 of the present disclosure.

FIG. 5 is a partial schematic diagram illustrating a region between each of the pairs of metal plates (1*a* and 1*b*) (2*a* and 2*b*) that form the heat transfer plates 1 and 2 included in the plate heat exchanger 100 according to Embodiment 1 of the present disclosure. FIG. 6 is a perspective view of a first example of the inner fins 4 and 5 included in the plate heat exchanger 100 according to Embodiment 1 of the present disclosure. FIG. 7 is a perspective view of a second example of the inner fins 4 and 5 included in the plate heat exchanger 100 according to Embodiment 1 of the present disclosure.

As illustrated in FIG. 5, the pairs of metal plates (1*a* and 1*b*) (2*a* and 2*b*) that form the heat transfer plates 1 and 2 are partially brazed together at the brazed portions 52 and thus joined together. Furthermore, between each pair of metal plates (1*a* and 1*b*) (2*a* and 2*b*), a plurality of outflow passages 51 are formed in a stripe pattern along the flat overlapping surfaces of the metal plates in such a manner as to communicate with the outside of the heat exchanger 100. The outflow passages 51 extend in the direction in which the first fluid and the second fluid flow, that is, along the first flow passages 6 and the second flow passages 7.

Also, between the outer wall portions 17 of each pair of metal plates (1*a* and 1*b*) (2*a* and 2*b*), outflow passages 51 are formed in a stripe pattern, as well as the above outflow passages 51.

The inner fins 4 and 5 according to Embodiment 1 receive heat from the heat transfer plates 1 and 2 and promote heat exchange because of, for example, an increase in the area for heat exchange with the fluids, a leading edge effect, and generation of a turbulent flow. The inner fins 4 and 5 are, for example, corrugated fins as illustrated in FIG. 6, or offset-type fins as illustrated in FIG. 7.

A method for manufacturing the plate heat exchanger 100 according to Embodiment 1 will be described.

First, the flat overlapping surfaces of each pair of metal plates (1*a* and 1*b*) (2*a* and 2*b*) are coated with an adhesion prevention material (for example, a material that contains a metal oxide as a main component and blocks flow of a brazing material) in a stripe pattern, and a brazing sheet (brazing material) made of, for example, copper, is put between the flat overlapping surfaces, thereby forming the heat transfer plates 1 and 2. Then, the heat transfer plates 1, the inner fins 4, the heat transfer plates 2, and the inner fins 5 are successively stacked, with the brazing sheets disposed between the heat transfer plates 1, the inner fins 4, the heat transfer plates 2, and the inner fins 5. Then, the heat transfer plates 1, the inner fins 4, the heat transfer plates 2, and the inner fins 5 are brought into tight contact with each other by applying a load in the stacking direction, and are brazed together by heat in a furnace. Thus, the heat transfer plates 1, the inner fins 4, the heat transfer plates 2, and the inner fins 5 are joined together, whereby the plate heat exchanger 100 is manufactured. In the above brazing process, portions on which the adhesion prevention material is provided are not joined together, and the outflow passages 51 are formed at the portions.

The heat exchange in the plate heat exchanger 100 according to Embodiment 1 will be described.

As illustrated in FIG. 1, the first fluid that has flowed into the first inlet pipe 12 flows into the first flow passages 6 through the first header 40. The first fluid that has flowed into the first flow passages 6 passes between the inner fins 4 and a first outlet header (not illustrated), and flows out through the first outlet pipe 9. Similarly, the second fluid flows through the second flow passages 7. The first fluid and the second fluid exchange heat with each other through the heat transfer plates 1 and 2 having the double wall structures.

In the case where the first fluid is refrigerant, and the second fluid is water or an antifreeze, large latent heat of evaporation/condensation of the first fluid can be used. Thus, in general, the mass flow rate of the first fluid is designed to be approximately 1/10 to 1/5 of the mass flow rate of the second fluid in order to reduce the power required to drive a device. Based on this operating condition, in Embodiment 1, the flow passage height of the first flow passages 6 (height and pitch of the inner fins 4) is optimized to be less than that of the second flow passages.

In the plate heat exchanger 100 of Embodiment 1 having the above structure, each pair of metal plates (1*a* and 1*b*) (2*a* and 2*b*) having the double wall structure are partially brazed together. Therefore, as compared with the case in which each pair of metal plates (1*a* and 1*b*) (2*a* and 2*b*) are brought into tight contact with each other but are not metal-joined together, the deterioration of the performance that is caused by an increase in the thermal resistance can be greatly reduced. In addition, the flow passage heights of the first flow passages 6 and the second flow passages 7 (heights and pitches of the inner fins 4 and 5) are optimized based on the operating conditions of the first fluid and the second fluid (flow rate, physical property value, etc., of each fluid). Therefore, the performance can be more greatly improved than in an existing plate heat exchanger having a double wall structure in which heat transfer plates having flow passages having the same corrugated shape are stacked together.

In addition, the outflow passages 51 are formed in a strip pattern along the overlapping surfaces in such a manner as to communicate with the outside of the heat exchanger 100 and have a sufficiently large passage-cross section. Therefore, even if, for example, corrosion or freezing occurs and a crack is formed in the heat transfer plates 1 and 2, fluid that has leaked can be made to flow out to the outside of the heat exchanger 100 without being mixed with the other fluid, and can be detected in a region outside the heat exchanger 100.

The height (a in FIG. 4) and width (b in FIG. 5) of the outflow passages 51 are determined to fall within the range of several micrometers to approximately 1 mm based on outflow conditions. When the width of the outflow passages 51 is increased, a partial brazing area is reduced and the thermal resistance is increased. It is therefore appropriate that the height of the outflow passages 51 is increased. To accurately form the above passage shape, it is necessary, for example, to control the conditions under which the adhesion prevention material is applied, the thickness of the brazing sheet, and the load applied in the brazing process, and to provide spacers or form projections on the metal plates 1*a*, 1*b*, 2*a*, and 2*b*.

It is hard to perform the above controls in the existing plate heat exchanger in which the heat transfer plates having corrugated flow passages are stacked together, since the heat transfer plates have a complicated shape and the pairs of metal plates need to be brought into tight contact with each other. In contrast, in the plate heat exchanger 100 of Embodiment 1, each pair of metal plates (1*a* and 1*b*) (2*a* and 2*b*) are partially brazed together to reduce the thermal resistance, and therefore do not need to be brought into tight contact with each other. In addition, since the metal plates (1*a* and 1*b*) (2*a* and 2*b*) have the flat overlapping surfaces, the above controls can be easily achieved, and the above passage shape can be accurately formed.

It should be noted that the heat exchange performance is also greatly affected by the ratio between the area of the brazed portions 52 and the area of the outflow passages 51. In each of heat exchange regions located between the openings 27 to 30 and in which the fluids exchange heat, that is, in each region in which the inner fins 4 are provided, when the area of the brazed portions 52 occupies 30% or more of the total area of the region, especially 50% or more of the total area of the region, or is further increased to occupy 70% or more of the total area of the region, the performance is greatly improved, as compared with an existing double wall structure having no brazed portions. When the area of the brazed portions 52 approaches 100% of the total area, the area of the outflow passages 51 decreases and the fluids cannot easily flow out. It is therefore appropriate that the area of the brazed portions 52 is set to occupy 90% or less of the total area.

Figure 8:
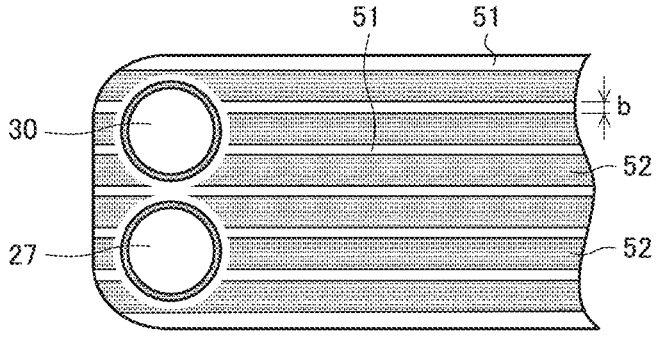
FIG. 8 is a partial schematic diagram illustrating a first modification of the region between each of the pairs of metal plates that form the heat transfer plates illustrated in FIG. 5.
Figure 9:
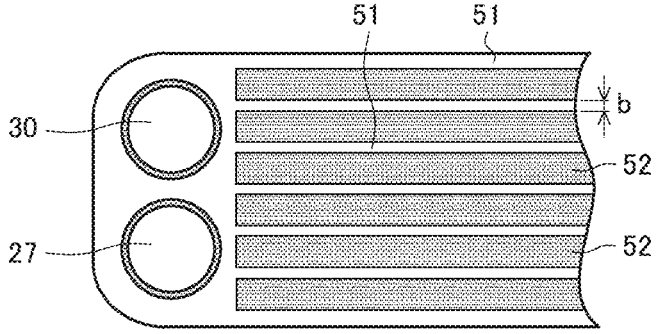
FIG. 9 is a partial schematic diagram illustrating a second modification of the region between each of the pairs of metal plates that form the heat transfer plates illustrated in FIG. 5.

FIG. 8 is a partial schematic diagram illustrating a first modification of the region between each of the pairs of metal plates (1*a* and 1*b*) (2*a* and 2*b*) that form the heat transfer plates 1 and 2 as illustrated in FIG. 5. FIG. 9 is a partial schematic diagram illustrating a second modification of the region between each of the pairs of metal plates (1*a* and 1*b*) (2*a* and 2*b*) that form the heat transfer plates 1 and 2 as illustrated in FIG. 5.

Although the brazed portions 52 having an annular shape need to be formed around the openings 27 to 30 to prevent the fluids from entering the spaces between the pairs of metal plates (1*a* and 1*b*) (2*a* and 2*b*) through the openings 27 to 30, it is not particularly necessary that the brazed portions 52 be formed in regions where the inner fins 4 are not provided. When the brazed portions 52 are additionally formed in the regions where the inner fins 4 are not provided as illustrated in FIG. 8, the heat exchange performance can be improved.

The area of the brazed portions 52 may be reduced to prevent freezing in regions where freezing of the fluids easily occurs. For example, in regions around the openings 27 to 30 into which the fluids flows, where freezing does not easily occur, the brazed portions 52 may be formed as illustrated in FIG. 8 to promote the heat exchange. In regions around the openings 27 to 30 from which the fluid flows out, where freezing easily occurs, the brazed portions 52 may be omitted as illustrated in FIG. 9 or the area of the brazed portions 52 may be reduced to reduce the heat exchange performance.

Thus, it is possible to improve the overall heat exchange performance while preventing freezing, by adequately distributing the brazed portions 52, for example, by reducing the area of the brazed portions 52 in the regions where freezing easily occurs. The brazed portions 52 may be arranged in a pattern such that the ratio of the area of the brazed portions 52 varies for freezing or other reasons not only at the openings 27 to 30 but at the heat exchange region.

As described above, the plate heat exchanger 100 includes the plurality of heat transfer plates 1 and 2 each of which have the openings 27 to 30 at the four corners thereof, and which are stacked together. The heat transfer plates 1 and 2 are partially brazed together such that the first flow passages 6 through which the first fluid flows and the second flow passages 7 through which the second fluid flows are alternately arranged, with the heat transfer plates 1 and 2 alternately interposed between the first flow passages 6 and the second flow passages 7. The openings 27 to 30 at the four corners are provided such that the openings 27 communicate with other, the openings 28 communicate with other, the openings 29 communicate with each other, and the openings 40 communicate with each other, thereby forming the first header 40 and the second header 41. The first header 40 allows the first fluid to flow into and flow out of the first flow passages 6, and the second header 41 allows the second fluid to flow into and flow out of the second flow passages 7. In the first flow passage 6 and the second flow passage 7, the inner fins 4 and the inner fins 5 are provided, respectively. At least one of two of the heat transfer plates 1 and 2 between which the first flow passage 6 or the second flow passage 7 is located is formed by stacking two metal plates (1*a* and 1*b*) or (2*a* and 2*b*) together. Each pair of metal plates (1*a* and 1*b*) or (2*a* and 2*b*) are partially brazed together at the brazed portions 52 such that the plurality of outflow passages 51 are formed between each pair of metal plates along overlapping surfaces thereof and communicate with the outside of the heat exchanger 100.

In the plate heat exchanger 100 according to Embodiment 1, each pair of metal plates (1*a* and 1*b*) (2*a* and 2*b*) arranged in the double wall structure are partially brazed together at the brazed portions 52 such that the outflow passages 51 are formed therebetween along the overlapping surfaces thereof in such a manner as to communicate with the outside. Therefore, the deterioration of the heat transfer performance can be further reduced than in the existing plate heat exchanger in which each pair of metal plates are brought into tight contact with each other, but are not metal-joined together. In addition, each pair of metal plates (1*a* and 1*b*) (2*a* and 2*b*) arranged in the double wall structure are partially brazed together such that the outflow passages 51 are formed therebetween along the overlapping surfaces thereof to communicate with the outside of the heat exchanger 100. Therefore, even if, for example, corrosion or freezing occurs and a crack is formed in the heat transfer plates 1 and 2, fluid that has leaked can be made to flow out to the outside of the heat exchanger 100 without being mixed with the other fluid, and can be detected in the region located outside the heat exchanger 100.

Embodiment 2

Embodiment 2 of the present disclosure will be described. Regarding Embodiment 2, components that are the same as or equivalent to those in Embodiment 1 will be denoted by the same reference signs, and their descriptions will thus be omitted.

Figure 10:
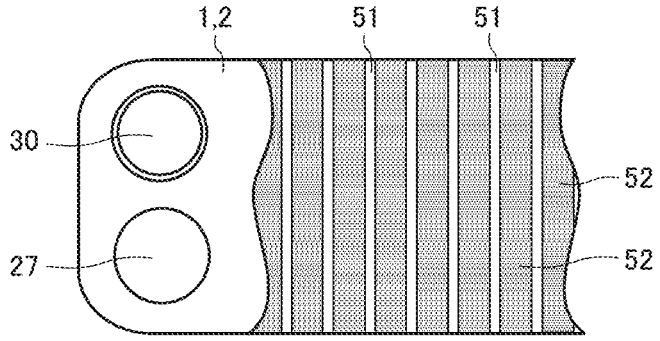
FIG. 10 is a partial schematic diagram illustrating a region between each of pairs of metal plates that form heat transfer plates included in a plate heat exchanger according to Embodiment 2 of the present disclosure.

FIG. 10 is a partial schematic diagram illustrating a region between each of pairs of metal plates (1*a* and 1*b*) (2*a* and 2*b*) that form heat transfer plates 1 and 2 included in a plate heat exchanger 100 according to Embodiment 2 of the present disclosure. FIG. 10 corresponds to FIG. 5 related to Embodiment 1.

Referring to FIG. 10, the pairs of metal plates (1*a* and 1*b*) (2*a* and 2*b*) that form the heat transfer plates 1 and 2 are partially brazed together at brazed portions 52 and joined together. Between each pair of metal plates (1*a* and 1*b*) (2*a* and 2*b*), a plurality of outflow passages 51 are provided along flat overlapping surfaces thereof such that they are arranged in a stripe pattern and communicate with the outside of the heat exchanger 100. The outflow passages 51 extend in a direction perpendicular to the direction in which the first fluid and the second fluid flow, that is, perpendicular to the first flow passages 6 and the second flow passages 7.

In the plate heat exchanger 100 of Embodiment 2 having the above structure, the outflow passages 51 that communicate with the outside of the heat exchanger 100 are formed along the overlapping surfaces. Therefore, as in Embodiment 1, even if, for example, corrosion or freezing occurs and a crack is formed in the heat transfer plates 1 and 2, fluid that has leaked can be made to flow out to the outside of the heat exchanger 100 without being mixed with the other fluid, and can be detected in the region located outside the heat exchanger 100. In addition, the outflow passages 51 are perpendicular to the first flow passages 6 and the second flow passages 7, and the lengths of the outflow passages 51 to the outside are short, as compared with the case where outflow passages 51 are formed to extend along the first flow passages 6 and the second flow passages 7. Thus, the flow passage resistance to the fluid that has leaked can be reduced. Therefore, the fluid can be made to flow out at a flow rate at which the leakage can be detected in the region located outside the heat exchanger 100.

Figure 11:
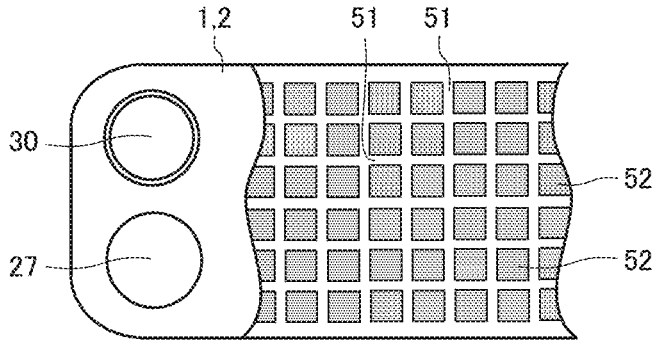
FIG. 11 is a partial schematic diagram illustrating a first modification of the region between each of the pairs of metal plates that form the heat transfer plates included in the plate heat exchanger according to Embodiment 2 of the present disclosure.

FIG. 11 is a partial schematic diagram illustrating a first modification of the region between each of the pairs of metal plates (1*a* and 1*b*) (2*a* and 2*b*) that form the heat transfer plates 1 and 2 included in the plate heat exchanger 100 according to Embodiment 2 of the present disclosure.

As illustrated in FIG. 11, the pairs of metal plates (1*a* and 1*b*) (2*a* and 2*b*) that form the heat transfer plates 1 and 2 are partially brazed together at brazed portions 52 and joined together. A plurality of outflow passages 51, which are arranged in a grid pattern and which communicate with the outside, are formed between each pair of metal plates (1*a* and 1*b*) (2*a* and 2*b*) along flat overlapping surfaces thereof.

In the plate heat exchanger 100 of Embodiment 2 having the above structure, the outflow passages 51 are arranged in a grid pattern. When flowing out the outside of the heat exchanger 100, the fluid that has leaked flows out from an outflow start position to the outside while branching off in the grid pattern. Therefore, the flow passage resistance to the fluid that has leaked can be reduced, and the fluid can be made to flow out at a flow rate at which the leakage can be detected in the outside space.

Figure 12:
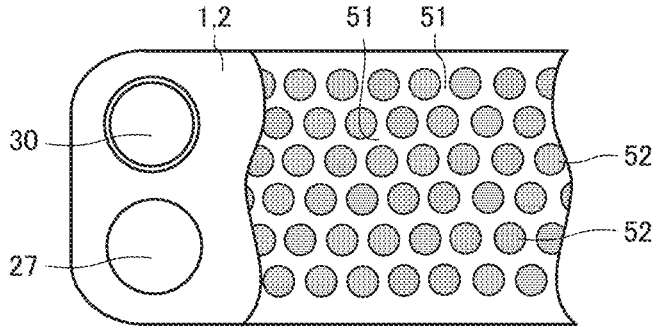
FIG. 12 is a partial schematic diagram illustrating a second modification of the region between each of the pairs of metal plates that form the heat transfer plates included in the plate heat exchanger according to Embodiment 2 of the present disclosure.

FIG. 12 is a partial schematic diagram illustrating a second modification of the region between each of the pairs of metal plates (1*a* and 1*b*) (2*a* and 2*b*) that form the heat transfer plates 1 and 2 included in the plate heat exchanger 100 according to Embodiment 2 of the present disclosure.

As illustrated in FIG. 12, the pairs of metal plates (1*a* and 1*b*) (2*a* and 2*b*) that form the heat transfer plates 1 and 2 are partially brazed together at circular brazed portions 52 and joined together. Outflow passages 51, which are arranged in a grid pattern and which communicate with the outside, are formed between each pair of metal plates (1*a* and 1*b*) (2*a* and 2*b*) along flat overlapping surfaces thereof.

In the plate heat exchanger 100 of Embodiment 2 having the above structure, the outflow passages 51 are arranged in a grid pattern, and when flowing out to the outside, the fluid that has leaked flows from an outflow start position to the outside while branching off in the grid pattern. The resistance to the fluid is largest between the outflow start position and the location where the fluid that has leaked branches into four fluids first. In the second modification of Embodiment 2, the flow passage width (cross section) is great at junction regions of the flow passages formed in the grid pattern. Therefore, the resistance to the fluid that has leaked can be reduced, and the fluid can be made to flow out at a sufficient flow rate.

Figure 13:
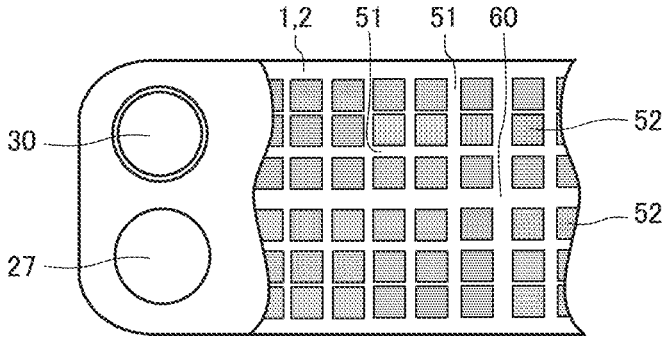
FIG. 13 is a partial schematic diagram illustrating a third modification of the region between each of the pairs of metal plates that form the heat transfer plates included in the plate heat exchanger according to Embodiment 2 of the present disclosure.

FIG. 13 is a partial schematic diagram illustrating a third modification of the region between each of the pairs of metal plates (1*a* and 1*b*) (2*a* and 2*b*) that form the heat transfer plates 1 and 2 included in the plate heat exchanger 100 according to Embodiment 2 of the present disclosure.

As illustrated in FIG. 13, the pairs of metal plates (1*a* and 1*b*) (2*a* and 2*b*) that form the heat transfer plates 1 and 2 are partially brazed together at brazed portions 52 and joined together. A plurality of outflow passages 51, which are arranged in a grid pattern and which communicate with the outside, are formed between each pair of metal plates (1*a* and 1*b*) (2*a* and 2*b*) along flat overlapping surfaces thereof. The flow passage width (flow passage cross section) of the outflow passages 51 increases from peripheral regions of the overlapping surfaces of the heat transfer plates 1 and 2 toward central regions of the overlapping surfaces.

In the above structure of the plate heat exchanger 100 of Embodiment 2, when the fluid that has leaked flows out to the outside of the heat exchanger 100, the lengths of outflow passages 51 located at the central regions of the overlapping surfaces of the heat transfer plates 1 and 2 are longer than those of the other outflow passages 51. Therefore, the passages in the grid pattern are formed such that the flow passage widths (cross sections) of passages located at the central regions are great. Thus, the resistance to the fluid that has leaked can be further reduced, and the fluid can be made to flow out at a sufficient flow rate.

As described above, in the plate heat exchanger 100 according to Embodiment 2, the resistance to the fluid that has leaked can be reduced by the outflow passages 51 arranged in the stripe pattern or the grid pattern. Therefore, the fluid that has leaked can be made to flow out to the outside at a flow rate at which the leakage can be detected in the region located outside the heat exchanger 100 without being mixed with the other fluid, and an air conditioner can be prevented from being damaged, by certainly stopping the apparatus provided with the plate heat exchanger 100.

Embodiment 3

Regarding Embodiment 3, components that are the same as or equivalent to those in Embodiment 1 will be denoted by the same reference signs, and their descriptions will thus be omitted.

Figure 14:
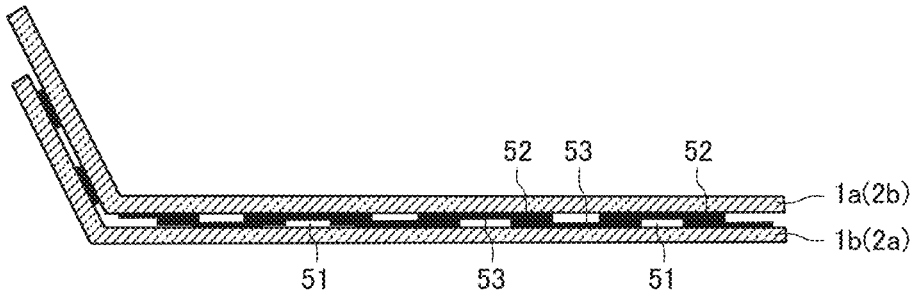
FIG. 14 is a sectional view of a heat transfer plate included in a plate heat exchanger according to Embodiment 3 of the present disclosure.

FIG. 14 is a sectional view of each of heat transfer plates 1 and 2 included in a plate heat exchanger 100 according to Embodiment 3 of the present disclosure. FIG. 14 corresponds to FIG. 4 related to Embodiment 1.

As illustrated in FIG. 14, pairs of metal plates (1*a* and 1*b*) (2*a* and 2*b*) that form the heat transfer plates 1 and 2 are partially brazed together at brazed portions 52 and joined together. A plurality of outflow passages 51, which communicate with the outside, are formed between each pair of metal plates (1*a* and 1*b*) (2*a* and 2*b*) along flat overlapping surfaces thereof. In addition, a brazing layer 53 is formed on one of surfaces of each pair of metal plates (1*a* and 1*b*) (2*a* and 2*b*) between which an associated one of the outflow passages 51 is formed (interposed).

In the plate heat exchanger 100 of Embodiment 3 having the above structure, the heat transfer plates 1 and 2 each have the double wall structure, and the space between each pair of metal plates (1*a* and 1*b*) (2*a* and 2*b*) in which the outflow passages 51 are formed is an air layer, and thus does not easily transmit heat. However, since the brazing layer 53 is formed on one of the surfaces of each pair of metal plates (1*a* and 1*b*) (2*a* and 2*b*) between which the associated outflow passage 51 is provided, heat is easily transmitted toward the brazed portions 52 along the overlapping surfaces of the heat transfer plates 1 and 2. Therefore, the thermal resistance can be further reduced by the partially brazed structure, and the thermal resistance made by the double wall structure can be reduced.

Although FIG. 14 shows that the brazing layer 53 is formed on only one of the surfaces of each pair of metal plates (1*a* and 1*b*) (2*a* and 2*b*) between which the associated outflow passage 51 is provided, this is not limiting. The brazing layers 53 may be formed on respective surfaces of each pair of metal plates (1*a* and 1*b*) (2*a* and 2*b*) between which the associated outflow passage 51 is formed. In such a case, the thermal resistance made by the double wall structure can be further reduced.

Embodiment 4

Embodiment 4 of the present disclosure will be described. Regarding Embodiment 4, components that are the same as or equivalent to those in any of Embodiments 1 to 3 will be denoted by the same reference signs, and their descriptions will thus be omitted.

Figure 15:
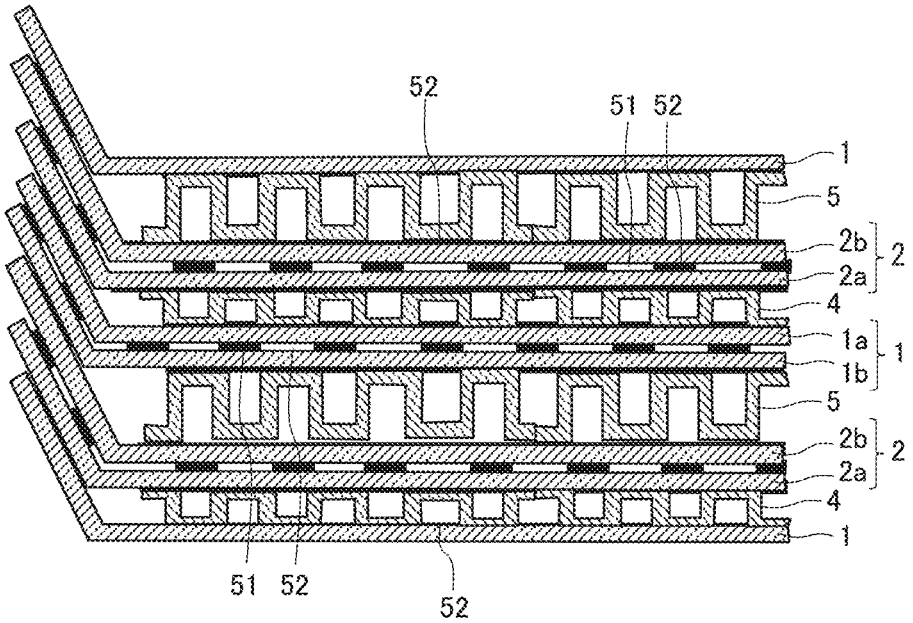
FIG. 15 is a sectional view of heat transfer plates included in a plate heat exchanger according to Embodiment 4 of the present disclosure.

FIG. 15 is a sectional view of heat transfer plates 1 and 2 included in a plate heat exchanger 100 according to Embodiment 4 of the present disclosure. FIG. 15 corresponds to FIG. 4 related to Embodiment 1.

As illustrated in FIG. 15, pairs of metal plates (1*a* and 1*b*) (2*a* and 2*b*) that form the heat transfer plates 1 and 2 are partially brazed together at brazed portions 52 and joined together. A plurality of outflow passages 51, which communicate with the outside, are formed between each pair of metal plates (1*a* and 1*b*) (2*a* and 2*b*) along flat overlapping surfaces thereof. In addition, inner fins 4 and 5 are brazed to surfaces of the pairs of metal plates (1*a* and 1*b*) (2*a* and 2*b*) that are located opposite to the surfaces on which the outflow passages 51 are formed.

In the plate heat exchanger 100 of Embodiment 4 having the above structure, the heat transfer plates 1 and 2 each have the double wall structure, and the space between each pair of metal plates (1*a* and 1*b*) (2*a* and 2*b*) in which the outflow passages 51 are formed is an air layer, and thus does not easily transmit heat. However, the inner fins 4 and 5 are brazed to the surfaces of the pairs of metal plates (1*a* and 1*b*) (2*a* and 2*b*) that are opposite to the surfaces on which the outflow passages 51 are formed. Thus, the plate heat exchanger 100 include three-layer structures including the heat transfer plates 1 and 2, brazing material layers, and the inner fins 4 and 5. As a result, heat is more easily transmitted toward the brazed portions 52. Therefore, the thermal resistance can be further reduced by the partially brazed structure, and the thermal resistance made by the double wall structure can be reduced.

Embodiment 5

Embodiment 5 of the present disclosure will now be described. Regarding Embodiment 5, components that are the same as or equivalent to those in any of Embodiments 1 to 4 will be denoted by the same reference signs, and their descriptions will thus be omitted.

Figure 16:
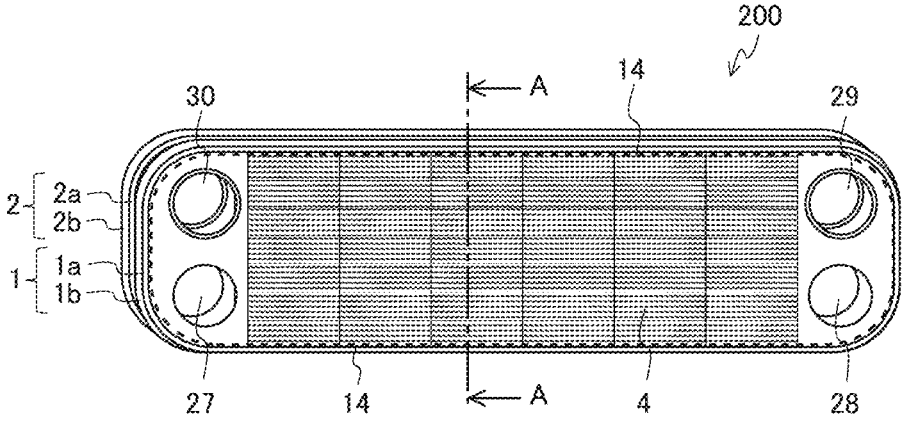
FIG. 16 is a front perspective view of heat transfer plates included in a plate heat exchanger according to Embodiment 5 of the present disclosure.

FIG. 16 is a front perspective view of heat transfer plates 1 and 2 included in a plate heat exchanger 100 according to Embodiment 5 of the present disclosure.

Between each of pairs of metal plates (1*a* and 1*b*) (2*a* and 2*b*) that form the heat transfer plates 1 and 2 according to Embodiment 5, a peripheral leakage passage 14 is provided along inner sides of outer wall portions 17. The peripheral leakage passage 14 communicates with a plurality of outflow passages 51, and also communicates with the outside. Therefore, the fluid that has leaked and that flows through the outflow passages 51 flows out the outside of the heat exchanger 100 after joining each other in the peripheral leakage passage 14.

Figure 17:
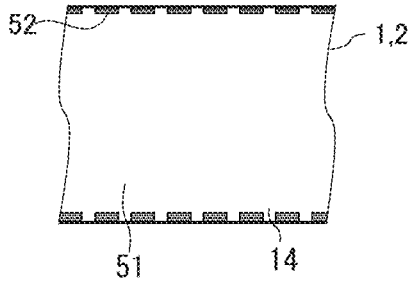
FIG. 17 is a partial schematic diagram illustrating a region between each of pairs of metal plates that form the heat transfer plates included in the plate heat exchanger according to Embodiment 5 of the present disclosure.
Figure 18:
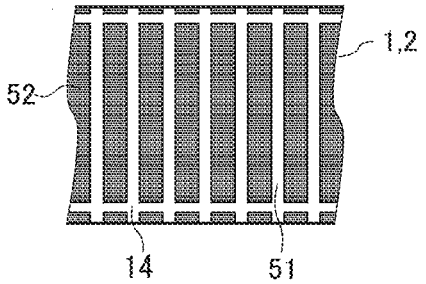
FIG. 18 is a partial schematic diagram illustrating a first modification of the region between each of the pairs of metal plates that form the heat transfer plates included in the plate heat exchanger according to Embodiment 5 of the present disclosure.
Figure 19:
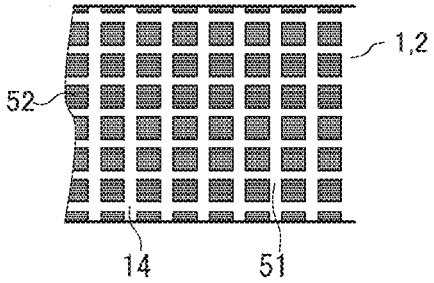
FIG. 19 is a partial schematic diagram illustrating a second modification of the region between each of the pairs of metal plates that form the heat transfer plates included in the plate heat exchanger according to Embodiment 5 of the present disclosure.

FIG. 17 is a partial schematic diagram illustrating a region between each of the pairs of metal plates (1*a* and 1*b*) (2*a* and 2*b*) that form the heat transfer plates 1 and 2 included in the plate heat exchanger 100 according to Embodiment 5 of the present disclosure. FIG. 18 is a partial schematic diagram illustrating a first modification of the region between each of the pairs of metal plates (1*a* and 1*b*) (2*a* and 2*b*) that form the heat transfer plates 1 and 2 included in the plate heat exchanger 100 according to Embodiment 5 of the present disclosure. FIG. 19 is a partial schematic diagram illustrating a second modification of the region between each of the pairs of metal plates (1*a* and 1*b*) (2*a* and 2*b*) that form the heat transfer plates 1 and 2 included in the plate heat exchanger 100 according to Embodiment 5 of the present disclosure.

As illustrated in FIG. 17, each pair of metal plates (1*a* and 1*b*) (2*a* and 2*b*) may be provided without being joined together in the heat exchange region such that the outflow passage 51 is formed in the entire heat exchange region. Alternatively, as illustrated in FIG. 18, the heat exchange region between each pair of metal plates (1*a* and 1*b*) (2*a* and 2*b*) may be coated with an adhesion prevention material in a stripe pattern, and a brazing sheet made of, for example, copper may be put between each pair of metal plates such that the plurality of outflow passages 51 are formed in a stripe pattern. Alternatively, as illustrated in FIG. 19, the heat exchange region between each pair of metal plates (1*a* and 1*b*) (2*a* and 2*b*) may be coated with an adhesion prevention material in a grid pattern, and a brazing sheet made of, for example, copper may be put between each pair of metal plats such that the plurality of outflow passages 51 are formed in a grid pattern.

In the plate heat exchanger 100 of Embodiment 5 having the above structure, between the pairs of metal plates (1*a* and 1*b*) (2*a* and 2*b*) that form the heat transfer plates 1 and 2, the peripheral leakage passage 14 is provided along the inner sides of the outer wall portions 17. Thus, even if some of the outflow passages 51 are clogged, the fluid that has leaked can be caused to join each other in the peripheral leakage passage 14, and then be made to flow out to the outside of the heat exchanger 100 through the other outflow passages 51. In addition, since the fluid that has leaked joins each other in the leakage passage 14, the fluid can be made to flow out at a flow rate at which the leakage can be detected earlier. In addition, since the number of passages through which the fluid flows out can be reduced, part of the heat exchanger 100 from which the fluid flows out to the outside of the heat exchanger 100 can be easily specified and detection sensors that detect leakage of the fluid in the region outside the heat exchanger 100 can be easily arranged. In addition, the number of the detection sensors can be reduced, and the cost can thus be reduced.

Embodiment 6

Embodiment 6 of the present disclosure will be described. Regarding Embodiment 6, components that are the same as or equivalent to those in any of Embodiments 1 to 6 will be denoted by the same reference signs, and their descriptions will thus be omitted.

Figure 20:
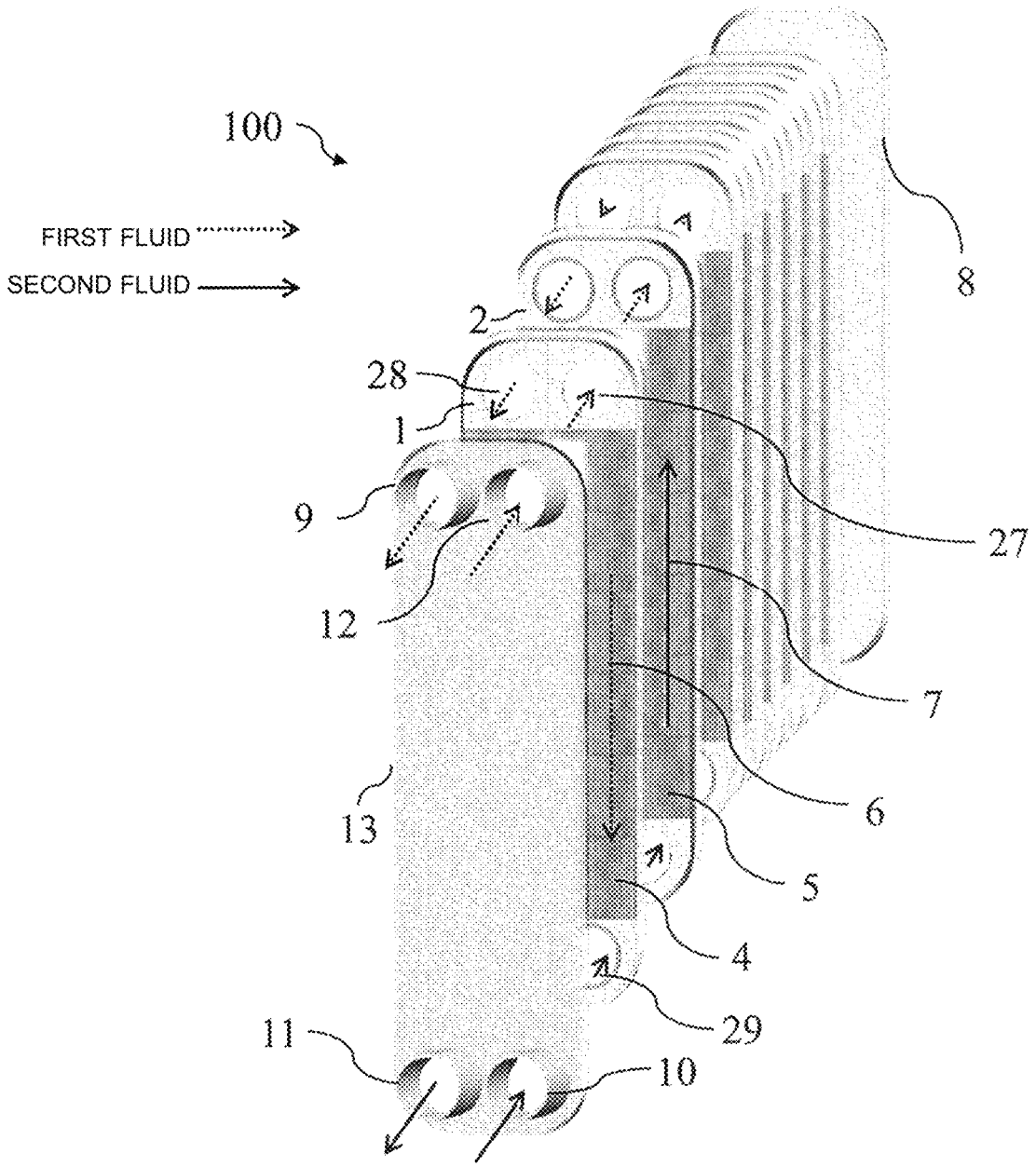
FIG. 20 is an exploded side perspective view of a plate heat exchanger according to Embodiment 6 of the present disclosure.
Figure 21:
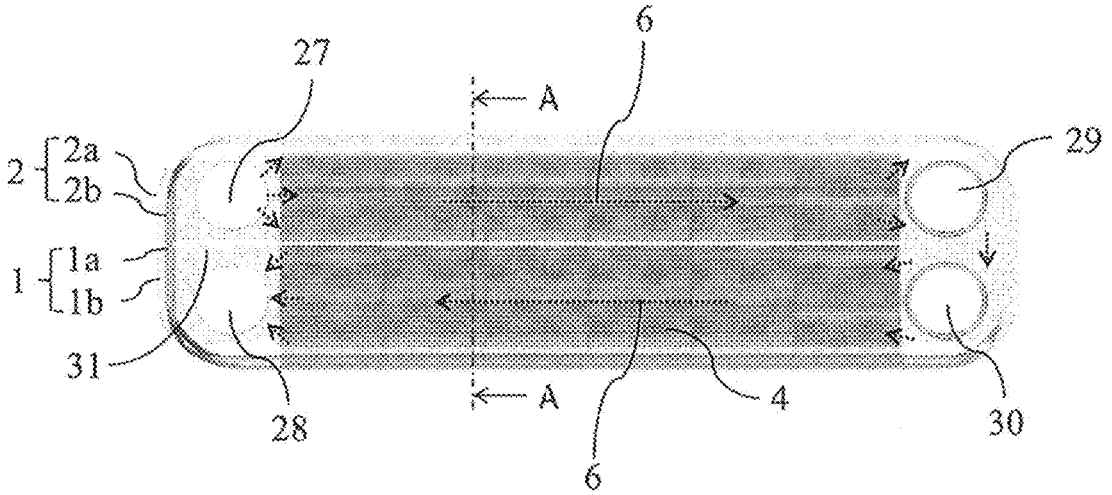
FIG. 21 is a front perspective view of a heat transfer set 200 included in the plate heat exchanger according to Embodiment 6 of the present disclosure.
Figure 22:
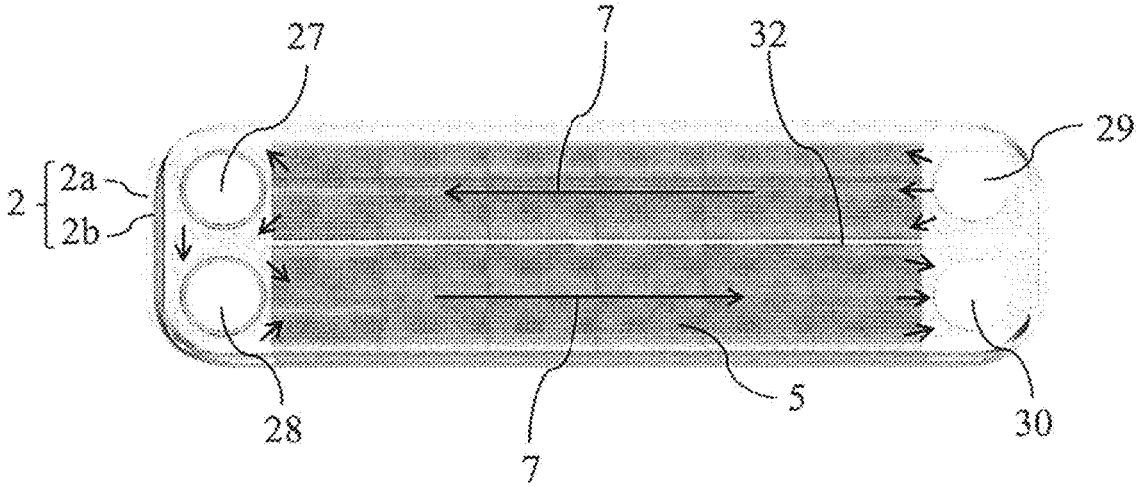
FIG. 22 is a front perspective view of a heat transfer plate 2 included in the plate heat exchanger according to Embodiment 6 of the present disclosure.
Figure 23:
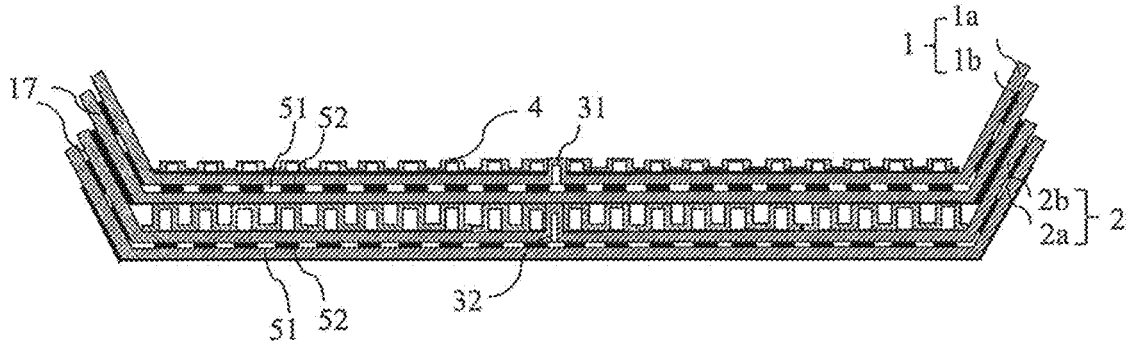
FIG. 23 is a sectional view of the heat transfer set included in the plate heat exchanger according to Embodiment 6 of the present disclosure taken along line A-A in FIG. 21.

FIG. 20 is an exploded side perspective view of a plate heat exchanger 100 according to Embodiment 6 of the present disclosure. FIG. 21 is a front perspective view of a heat transfer set 200 included in the plate heat exchanger 100 according to Embodiment 6 of the present disclosure. FIG. 22 is a front perspective view of a heat transfer plate 2 included in the plate heat exchanger 100 according to Embodiment 6 of the present disclosure. FIG. 23 is a sectional view of the heat transfer set 200 included in the plate heat exchanger 100 according to Embodiment 6 of the present disclosure, which is taken along line A-A in FIG. 21.

As illustrated in FIGS. 21 to 23, in the plate heat exchanger 100 according to Embodiment 6, between the pairs of metal plates (1*a* and 1*b*) (2*a* and 2*b*), partition passages 31 and 32 are provided to extend in the longitudinal direction. The partition passages 31 and 32 are connected with a plurality of outflow passages 51, which are arranged in a stripe pattern and which communicate with the outside.

As illustrated in FIG. 23, the partition passage 31 is formed by forming a projection on the metal plate 1*a* and joining the metal plates 1*a* and 1*b* together. The partition passage 32 is formed by forming a projection on the metal plate 2*b* and joining the metal plates 2*a* and 2*b* together.

Although the partition passages 31 and 32 are formed by forming projections on the metal plates 1*a* and 2*b* as illustrated in FIG. 23, this is not limiting. For example, the partition passages 31 and 32 may be formed by forming projections or recesses on or in at least one of the pair of metal plates (1*a* and 1*b*) and at least one of the pair of metal plates (2*a* and 2*b*).

In each first flow passage 6, the projecting outer wall of an associated partition passage 31 is brazed to an associated metal plate 2*a* to form a partition in the first flow passage 6. In each second flow passage 7, the projecting outer wall of an associated partition passage 32 is brazed to an associated metal plate 1*b* to form a partition in the second flow passage 7.

As illustrated in FIG. 21, the first fluid in each first flow passage 6 can be made to make a U-turn by the partition in the first flow passage 6. To be more specific, in each first flow passage 6, the first fluid makes a U-turn and flows in the following manner. The first fluid that has flowed into the first flow passage 6 through the opening 27 flows toward the opening 29 through a flow passage formed between the partition in the first flow passage 6 and the outer wall portions 17 of the first flow passage 6, makes a U-turn through a flow passage around the opening 29 and the opening 30, flows toward the opening 28 through a flow passage formed between the partition in the first flow passage 6 and the wall portions 17 of the first flow passage 6, and then flows out through the opening 28.

As illustrated in FIG. 22, the second fluid in each second flow passage 7 can be made to make a U-turn by the partition in the second flow passage 7. To be more specific, in each second flow passage 7, the second fluid makes a U-turn and flows in the following manner. The second fluid that has flowed into the second flow passage 7 through the opening 29 flows toward the opening 27 through a flow passage formed between the partition in the second flow passage 7 and the outer wall portions 17 of the second flow passage 7, makes a U-turn through a flow passage around the opening 27 and the opening 28, flows toward the opening 30 through a flow passage formed between the partition in the second flow passage 7 and the outer wall portions 17 of the second flow passage 7, and then flows out through the opening 30.

Since the partition passages 31 and 32 overlap the outflow passages 51, the partition passages 31 and 32 serve as portions of the outflow passages 51. Therefore, the flow passage resistance to the fluid that has leaked is less than in the case where only the outflow passages 51 that are arranged in a stripe pattern and that communicate with the outside are provided, and the fluid can be made to flow at a flow rate at which the leakage can be detected in the region outside the heat exchanger 100. In the case where the outflow passages 51 as illustrated in FIG. 10 are provided to extend perpendicular to the first flow passages 6 and the second flow passages 7, the outflow passages 51 form together with the additionally formed partition passages 31, outflow passages in such a grid pattern as illustrated in FIG. 11. Therefore, when flowing out to the outside, the fluid that has leaked flows out from an outflow start position to the outside while branching off in the grid pattern. Thus, the flow passage resistance to the fluid that has leaked can be reduced, and the fluid can be made to flow out at a sufficient high flow rate at which the leakage can be detected in the region outside the heat exchanger 100.

Furthermore, because of provision of the partition passages 31 and 32, the flow passage width (width in a direction perpendicular to the flow) of the flow passages can be reduced by half. Thus, when flowing into the inner fins 4 through the opening 27, the first fluid can be made to evenly flow into the spaces between the inner fins 4. Therefore, the heat exchange performance of the plate heat exchanger 100 can be improved. In the case where the first fluid is refrigerant and the second fluid is water or an antifreeze, when evaporating, the first fluid flows in a two-phase gas-liquid state in which gas and liquid are mixed, and the ratio of gas increases as the liquid gradually evaporates. By contrast, when condensing, the first fluid flows in a gaseous state, and the ratio of gas decreases as the gas gradually condenses. Therefore, when the first fluid evaporates, the pressure loss increases as the location is closer to the outlet, and when the first fluid condenses, the pressure loss increases as the location is closer to the inlet. Thus, as illustrated in FIG. 21 (which illustrates the flow of the fluid in the case where the fluid evaporates), a downstream region of the flow passage from the opening 30 to the opening 28 may be formed to have a flow passage width less than that of an upstream region of the above flow passage, whereby the pressure loss can be reduced and the heat exchange performance can thus be improved. Although the partition passage 32 for the second fluid serves as a heat loss passage, since the partition passage 32 has a hollow structure, the heat loss passage has a sufficiently high thermal resistance. Thus, the influence of the partition passage 32 on the performance is small.

Embodiment 7

Embodiment 7 of the present disclosure will now be described. Regarding Embodiment 7, components that are the same as or equivalent to those in any of Embodiments 1 to 6 will be denoted by the same reference signs, and their descriptions will thus be omitted.

Figure 24:
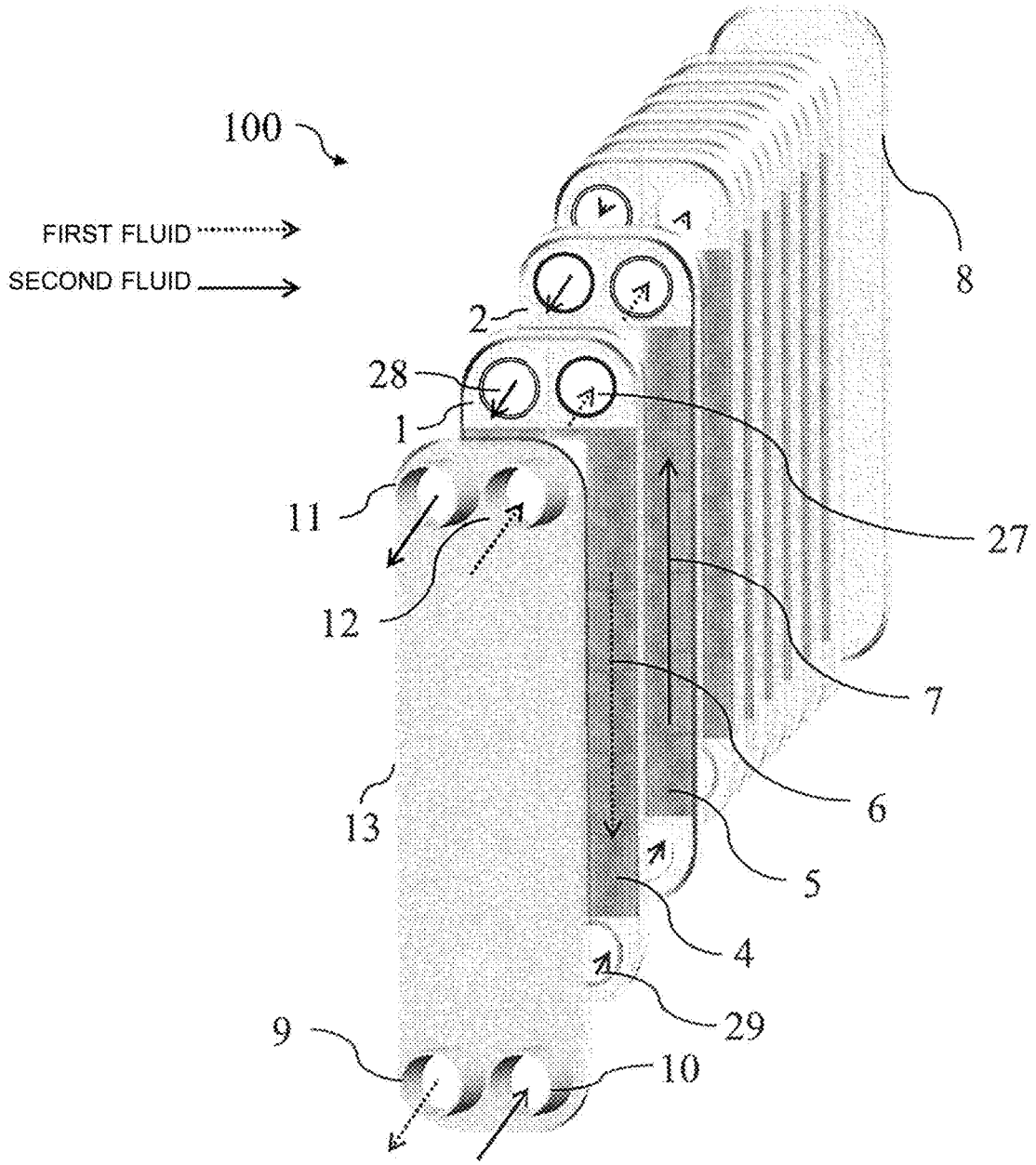
FIG. 24 is an exploded side perspective view of a plate heat exchanger according to Embodiment 7 of the present disclosure.
Figure 25:
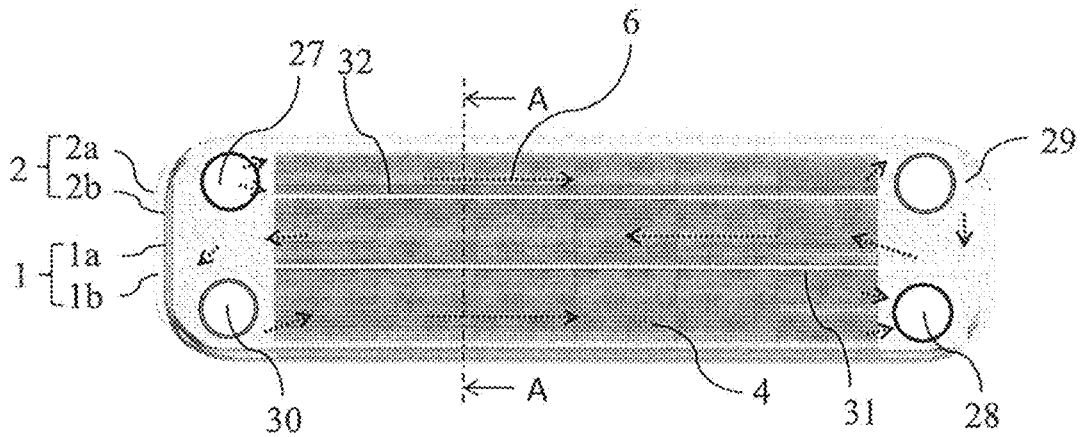
FIG. 25 is a front perspective view of a heat transfer set 200 included in the plate heat exchanger according to Embodiment 7 of the present disclosure.
Figure 26:
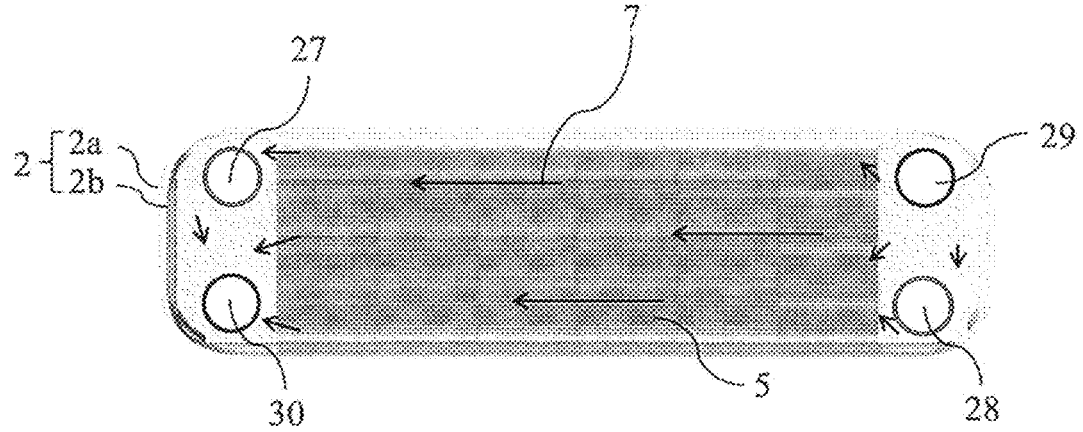
FIG. 26 is a front perspective view of a heat transfer plate 2 included in the plate heat exchanger according to Embodiment 7 of the present disclosure.
Figure 27:
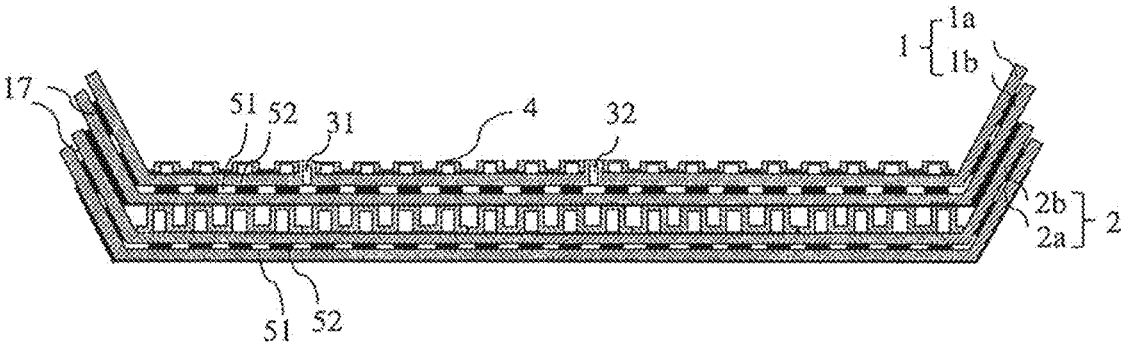
FIG. 27 is a sectional view of the heat transfer set included in the plate heat exchanger according to Embodiment 7 of the present disclosure, which is taken along line A-A in FIG. 25.

FIG. 24 is an exploded side perspective view of a plate heat exchanger 100 according to Embodiment 7 of the present disclosure. FIG. 25 is a front perspective view of a heat transfer set 200 included in the plate heat exchanger 100 according to Embodiment 7 of the present disclosure. FIG. 26 is a front perspective view of a heat transfer plate 2 included in the plate heat exchanger 100 according to Embodiment 7 of the present disclosure. FIG. 27 is a sectional view of the heat transfer set 200 included in the plate heat exchanger 100 according to Embodiment 7 of the present disclosure, which is taken along line A-A in FIG. 25.

As illustrated in FIGS. 25 to 27, in the plate heat exchanger 100 according to Embodiment 7, between the pair of metal plates (1*a* and 1*b*), partition passages 31 and 32 are provided to extend in the longitudinal direction. The partition passages 31 and 32 are connected with a plurality of outflow passages 51, which are arranged in a stripe pattern and which communicate with the outside of the heat exchanger 100.

As illustrated in FIG. 27, the partition passages 31 and 32 are formed by forming projections on the metal plate 1*a* and joining the metal plate 1*a* and the metal plate 1*b* together.

As described above, in the plate heat exchanger 100 of Embodiment 7 having the above structure, two partition passages 31 and 32 are formed in one flow passage, and in addition to the advantage of Embodiment 6, it is therefore possible to obtain the following advantages. The flow passage resistance to the fluid that has leaked can be further reduced, and the fluid can be made to flow out at a sufficient high flow rate at which the leakage can be detected in the space located outside the heat exchanger 100. In addition, because of provision of the partition passages 31 and 32, an S-shaped meandering flow is made, and the flow passage width (width in a direction perpendicular to the flow) of the flow passages can thus be further reduced. Therefore, when flowing into the inner fins 4 through the opening 27, the first fluid can be made to more evenly flow into the inner fins 4. Therefore, the heat exchange performance of the plate heat exchanger 100 can be improved. Furthermore, in the case where the first fluid is refrigerant and the second fluid is water or an antifreeze, as illustrated in FIG. 25 (which illustrates the flow in the evaporating process), three flow passages from the opening 27 to the opening 28 are formed such that the flow passage width thereof decreases as the location is closer to the upstream side. Thus, the pressure loss can be reduced and the heat exchange performance can be improved.

Embodiment 8

Embodiment 8 of the present disclosure will be described. Regarding Embodiment 8, components that are the same as or equivalent to those in any of Embodiments 1 to 7 will be denoted by the same reference signs, and their descriptions will thus be omitted.

A heat pump device 26 to which the plate heat exchanger 100 described regarding any one of Embodiments 1 to 7 is applied will be described in Embodiment 8. A heat pump type of cooling, heating, and hot water supply system 300 will be described as an example of application of the heat pump device 26.

Figure 28:
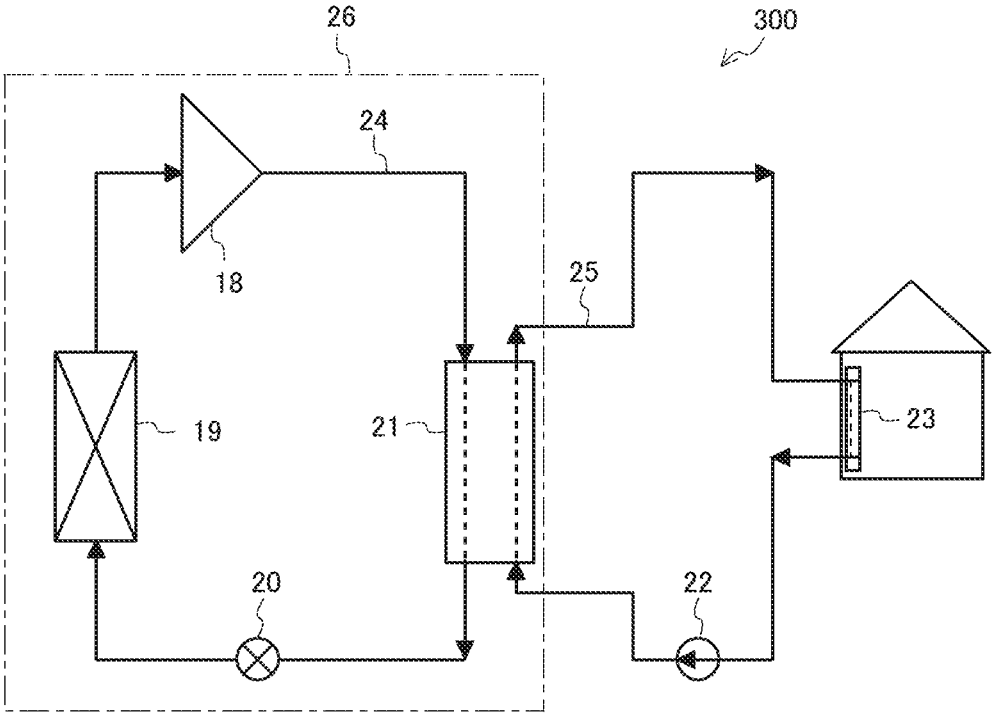
FIG. 28 is a schematic diagram illustrating the structure of a heat pump type of cooling, heating, and hot water supply system according to Embodiment 8 of the present disclosure.

FIG. 28 is a schematic diagram illustrating a configuration of the heat pump type of cooling, heating, and hot water supply system 300 according to Embodiment 8 of the present disclosure.

As illustrated in FIG. 28, the heat pump type of cooling, heating, and hot water supply system 300 according to Embodiment 8 includes the heat pump device 26 provided in a housing. The heat pump device 26 includes a refrigerant circuit 24 in which refrigerant is circulated and a heat medium circuit 25 in which a heat medium is circulated. In the refrigerant circuit 24, a compressor 18, a first heat exchanger 21, a pressure reducing device 20, and a second heat exchanger 19 are sequentially connected by pipes. The pressure reducing device 20 is, for example, an expansion valve or a capillary tube. In the heat medium circuit 25, the first heat exchanger 21, a cooling, heating, and hot water supply apparatus 23, and a pump 22 that circulates the heat medium are sequentially connected by pipes.

The first heat exchanger 21 is the plate heat exchanger 100 according to any one of Embodiments 1 to 7, and causes heat exchange to be performed between the refrigerant circulated in the refrigerant circuit 24 and the heat medium circulated in the heat medium circuit 25. The heat medium circulated in the heat medium circuit 25 may be any fluid capable of exchanging heat with the refrigerant in the refrigerant circuit 24, such as water, ethylene glycol, propylene glycol, or a mixture thereof. The refrigerant is, for example, R410A, R32, R290, or $CO_2$.

The plate heat exchanger 100 is provided in the refrigerant circuit 24 such that the refrigerant flows through the first flow passages 6 and the heat medium flows through the second flow passages 7.

The cooling, heating, and hot water supply apparatus 23 includes a hot water tank (not illustrated) and an indoor unit (not illustrated) that air-conditions an indoor space. The heat medium that flows through the heat medium circuit 25 exchanges heat with the refrigerant that flows through the refrigerant circuit 24 in the plate heat exchanger 100, and is thereby heated. The heated heat medium is stored in the hot water tank (not illustrated). Furthermore, the heated heat medium is guided to a heat exchanger included in the indoor unit (not illustrated), and exchanges heat with indoor air, thereby heating the indoor air. The heated indoor air is sent into the indoor space to heat the indoor space.

Although it is not illustrated, in a cooling operation, the direction in which the refrigerant flows in the refrigerant circuit 24 is reversed by, for example, a four-way valve, and the heat medium that flows through the heat medium circuit 25 exchanges heat with the refrigerant that flows through the refrigerant circuit 24 in the plate heat exchanger 100, and is thereby cooled. The cooled heat medium is guided to the heat exchanger included in the indoor unit (not illustrated), and exchanges heat with indoor air, thereby cooling the indoor air. The cooled indoor air is sent into the indoor space to cool the indoor space.

The configuration of the cooling, heating, and hot water supply apparatus 23 is not limited to the above configuration. As the configuration of the cooling, heating, and hot water supply apparatus 23, any configuration may be applied as long as the cooling, heating, and hot water supply apparatus 23 having the configuration enables cooling, heating, and hot water supply operations to be performed using heating energy or cooling energy of the heat medium in the heat medium circuit 25.

As described above regarding Embodiments 1 to 7, the plate heat exchanger 100 includes the inner fins 4 and 5 whose flow passage shapes can be optimized for the flows of the respective fluids to improve the performance of the plate heat exchanger 100. Furthermore, in the plate heat exchanger 100, the deterioration of the heat transfer performance, which is a disadvantage of a double wall structure, can be reduced, and even if, for example, corrosion or freezing occurs and a crack is formed in the heat transfer plates 1 and 2, both fluids can be made to flow out to the outside of the heat exchanger 100 without being mixed with each other, and can be detected in the region located outside the heat exchanger 100. The plate heat exchanger 100 has a high performance, and can be made at a low cost.

Thus, in the case where the heat pump type of cooling, heating, and hot water supply system 300 according to Embodiment 8 is provided with the plate heat exchanger 100, the heat pump type of cooling, heating, and hot water supply system 300 can be operated with a high efficiency and a high reliability, and the power consumption and $CO_2$ emissions thereof can be reduced.

In Embodiment 8, the heat pump type of cooling, heating, and hot water supply system 300 that causes heat exchange to be performed between refrigerant and water is described above as an example of a heat pump type of cooling, heating, and hot water supply system to which the plate heat exchanger 100 is applied. However, each of the plate heat exchangers 100 according to Embodiments 1 to 7 can be applied not only to the heat pump type of cooling, heating, and hot water supply system 300, and but to various industrial and domestic devices, such as a cooling chiller, a power generating apparatus, or a heat sterilization device for food.

REFERENCE SIGNS LIST

1 heat transfer plate 1*a* metal plate 1*b* metal plate 2 heat transfer plate 2*a* metal plate 2*b* metal plate 4 inner fin 5 inner fin 6 first flow passage 7 second flow passage 8 second reinforcing side plate 9 first outlet pipe 10 second inlet pipe 11 second outlet pipe 12 first inlet pipe 13 first reinforcing side plate 14 peripheral leakage passage 17 outer wall portion 18 compressor 19 second heat exchanger 20 pressure reducing device 21 first heat exchanger 22 pump 23 hot water supply apparatus 24 refrigerant circuit heat medium circuit 26 heat pump device 27 opening 28 opening 29 opening 30 opening 31 partition passage 32 partition passage 40 first header 41 second header 51 outflow passage 52 brazed portion 53 brazing layer 100 plate heat exchanger 300 hot water supply system

The invention claimed is:

1. A plate heat exchanger comprising:

a plurality of heat transfer plates each of which has openings at four corner portions thereof, the plurality of heat transfer plates being stacked together, wherein at least one of the plurality of heat transfer plates has two metal plates stacked together such that flat surfaces of the two metal plates overlap each other, wherein the plurality of heat transfer plates are partially brazed together such that a first flow passage through which first fluid flows and a second flow passage through which second fluid flows are alternately arranged, with an associated one of the plurality of heat transfer plates interposed between the first flow passage and the second flow passage, the openings at the four corner portions are provided such that the openings at each of the four corner portions communicate with each other, thereby forming a first header and a second header, the first header being to allow the first fluid to flow into and out of the first flow passage, and the second header being to allow the second fluid to flow into and out of the second flow passage, wherein inner fins are in each of the first flow passage and the second flow passage, wherein said one of the plurality of heat transfer plates between the first flow passage and the second flow passage is said at least one heat transfer plate having the two metal plates stacked together, and wherein the flat surfaces of the two metal plates that overlap each other are partially brazed together such that a plurality of outflow passages are between portions of the flat surfaces that are not brazed together, in such a manner as to communicate with outside of the plate heat exchanger.

2. The plate heat exchanger of claim 1, wherein the plurality of outflow passages are in a stripe pattern or a grid pattern.

3. The plate heat exchanger of claim 1, wherein a brazed portion at which the flat surfaces are brazed together has a circular shape.

4. The plate heat exchanger of claim 1, wherein a brazing layer is on at least one of the flat surfaces of the two metal plates between which the plurality of outflow passages are formed.

5. The plate heat exchanger of claim 1, wherein each of the plurality of heat transfer plates has the two metal plates stacked together such that the flat surfaces of the two metal plates overlap each other, and wherein the inner fins of each of the first and the second flow passages are brazed to the flat surfaces of one of the two metal plates of each the heat transfer plates that are on opposite sides of the first flow passage or the second flow passage.

6. The plate heat exchanger of claim 1, wherein at least one of the two metal plates has a projection or a recess that forms a partition passage that isolates the first flow passage and the second flow passage from each other.

7. The plate heat exchanger of claim 6, wherein the partition passage overlaps with the plurality of outflow passages.

8. The plate heat exchanger of claim 6, wherein an outer wall of the partition passage is brazed and forms a partition in the first flow passage or the second flow passage.

9. A heat pump device comprising:

a refrigerant circuit in which a compressor, a heat exchanger, a pressure reducer, and the plate heat exchanger of claim 1 are connected, and refrigerant is circulated; and a heat medium circuit in which a heat medium is circulated, the heat medium exchanging heat with the refrigerant in the plate heat exchanger.

10. The plate heat exchanger of claim 1, wherein the plurality of heat transfer plates each include outer wall portions at edges of the plurality of heat transfer plates, and the outer wall portions are bent from the plurality of heat transfer plates in a direction in which the plurality of heat transfer plates are stacked together, and wherein the plurality of outflow passages are defined as spaces between the outer wall portions of each of the plurality of heat transfer plates, which are located between the two metal plates.

11. The plate heat exchanger of claim 1, wherein no fins are provided between the two metal plates of said at least one of the plurality of heat transfer plates.

12. The plate heat exchanger of claim 1, wherein the plurality of outflow passages are formed between the two metal plates, and wherein a height of the outflow passages between the two metal plates is equal to or less than a height of brazing material associated with brazing of the two metal plates.

13. The plate heat exchanger of claim 1, wherein in each region in which the inner fins are provided, when an area of a brazed portion at which the flat surfaces are brazed together occupies 30% or more and 90% or less of a total area of the region.

14. A plate heat exchanger, comprising:

a plurality of heat transfer plates each of which has openings at four corner portions thereof, the plurality of heat transfer plates being stacked together, wherein at least one of the plurality of heat transfer plates has two metal plates stacked together, wherein the plurality of heat transfer plates are partially brazed together such that a first flow passage through which first fluid flows and a second flow passage through which second fluid flows are alternately arranged, with an associated one of the plurality of heat transfer plates interposed between the first flow passage and the second flow passage, the openings at the four corner portions are provided such that the openings at each of the four corner portions communicate with each other, thereby forming a first header and a second header, the first header being configured to allow the first fluid to flow into and out of the first flow passage, and the second header being to allow the second fluid to flow into and out of the second flow passage, wherein inner fins are in each of the first flow passage and the second flow passage, wherein said one of the plurality of heat transfer plates between the first flow passage and the second flow passage is said at least one heat transfer plate having the two metal plates stacked together, wherein the two metal plates are partially brazed together at a brazed portion such that a plurality of outflow passages are between the two metal plates along overlapping surfaces thereof, the plurality of outflow passages communicating with outside of the heat exchanger, wherein the plurality of outflow passages are in a grid pattern, and wherein a central region of each of the plurality of outflow passages has a larger flow-passage cross section than a flow-passage cross section of a peripheral region of each said outflow passage.

15. A plate heat exchanger comprising:

a plurality of heat transfer plates each of which has openings at four corner portions thereof, the plurality of heat transfer plates being stacked together, wherein at least one of the plurality of heat transfer plates has two metal plates stacked together, wherein the plurality of heat transfer plates are partially brazed together such that a first flow passage through which first fluid flows and a second flow passage through which second fluid flows are alternately arranged, with an associated one of the plurality of heat transfer plates interposed between the first flow passage and the second flow passage, the openings at the four corner portions are provided such that the openings at each of the four corner portions communicate with each other, thereby forming a first header and a second header, the first header being to allow the first fluid to flow into and out of the first flow passage, the second header being to allow the second fluid to flow into and out of the second flow passage, wherein inner fins are in each of the first flow passage and the second flow passage, wherein said one of the plurality of heat transfer plates between the first flow passage and the second flow passage is said at least one heat transfer plate having the two metal plates stacked together, wherein the two metal plates are partially brazed together at a brazed portion such that a plurality of outflow passages are between the two metal plates along overlapping surfaces thereof, the plurality of outflow passages communicating with outside of the heat exchanger, wherein outer wall portions are at edges of the two metal plates, and wherein a peripheral leakage passage in communication with the plurality of outflow passages is between the two metal plates and inward of the outer wall portions.

16. The plate heat exchanger of claim 14, wherein the brazed portion has a circular shape.

17. The plate heat exchanger of claim 14, wherein a brazing layer is on at least one of the two metal plates between which the plurality of outflow passages are formed.

18. The plate heat exchanger of claim 14, wherein each of the plurality of heat transfer plates has the two metal plates stacked together.

19. The plate heat exchanger of claim 14, wherein no fins are provided between the two metal plates stacked of said at least one of the plurality of heat transfer plates.

20. The plate heat exchanger of claim 15, wherein the plurality of outflow passages are in a stripe pattern or a grid pattern.

21. The plate heat exchanger of claim 20, wherein at least one of the two metal plates has a projection or a recess that forms a partition passage that isolates the first flow passage and the second flow passage from each other, and wherein the partition passage overlaps with the plurality of outflow passages.

22. The plate heat exchanger of claim 20, wherein no fins are provided between the two metal plates of said at least one of the plurality of heat transfer plates.

* * * * *